US011446696B2

(12) United States Patent
Suzuki et al.

(10) Patent No.: US 11,446,696 B2
(45) Date of Patent: Sep. 20, 2022

(54) DISCHARGE DEVICE AND LIQUID SUPPLY METHOD

(71) Applicant: THREEBOND CO., LTD., Tokyo (JP)

(72) Inventors: Ryota Suzuki, Tokyo (JP); Naoya Saito, Tokyo (JP)

(73) Assignee: THREEBOND CO., LTD., Tokyo (JP)

( * ) Notice: Subject to any disclaimer, the term of this patent is extended or adjusted under 35 U.S.C. 154(b) by 81 days.

(21) Appl. No.: 16/964,412

(22) PCT Filed: Dec. 14, 2018

(86) PCT No.: PCT/JP2018/046178
§ 371 (c)(1),
(2) Date: Jul. 23, 2020

(87) PCT Pub. No.: WO2019/150790
PCT Pub. Date: Aug. 8, 2019

(65) Prior Publication Data

US 2021/0046502 A1 Feb. 18, 2021

(30) Foreign Application Priority Data

Feb. 2, 2018 (JP) ..... JP2018-017331

(51) Int. Cl.
*B05C 5/02* (2006.01)
*B05C 11/10* (2006.01)

(52) U.S. Cl.
CPC ..... *B05C 5/02* (2013.01); *B05C 11/1026* (2013.01)

(58) Field of Classification Search
CPC ..... B05C 5/02; B05C 11/1026
See application file for complete search history.

(56) References Cited

U.S. PATENT DOCUMENTS 4,842,162 A * 6/1989 Merkel ..... B05C 5/0225 222/1
5,207,352 A * 5/1993 Porter ..... B05C 5/0225 222/1

(Continued)

FOREIGN PATENT DOCUMENTS

JP H11-235546 A 8/1999
JP 2003-247492 A 9/2003

(Continued)

OTHER PUBLICATIONS

CNIPA, Office Action for the corresponding Chinese patent application No. 201880085552.3, dated Aug. 4, 2021, with English translation.

(Continued)

*Primary Examiner* — Jeremy Carroll
(74) *Attorney, Agent, or Firm* — Lucas & Mercanti, LLP

(57) ABSTRACT

Technical Problem Provide is a discharge device capable of easily controlling an operation of a plunger at the time of supplying a viscous material to a cylinder and a liquid supply method capable of forming a desired overlap portion. Solution to Problem The discharge device 10 includes the supply valve 40 which controls the supply of the viscous material M to the cylinder 30, the plunger 50 which applies a pressure to the viscous material supplied to the cylinder, the ball screw 60 which is movable in the same direction as the back-and-forth direction of the plunger, and the motor 120 which is connected to the ball screw through the power transmission mechanism 110, wherein the plunger and the ball screw are not connected.

8 Claims, 9 Drawing Sheets

(56) References Cited

U.S. PATENT DOCUMENTS

| | | | | |
|---|---|---|---|---|
| 5,348,585 | A * | 9/1994 | Weston | B05C 5/02 118/305 |
| 5,375,738 | A * | 12/1994 | Walsh | B05C 5/001 222/1 |
| 2003/0132243 | A1* | 7/2003 | Engel | B05C 11/1002 222/61 |
| 2014/0124537 | A1* | 5/2014 | Urquhart | B05C 5/02 222/148 |
| 2015/0028055 | A1* | 1/2015 | Hayama | B05C 5/025 222/55 |

FOREIGN PATENT DOCUMENTS

| | | | |
|---|---|---|---|
| JP | 2007-187003 | A | 7/2007 |
| JP | 2007-222768 | A | 9/2007 |
| JP | 2008-008232 | A | 1/2008 |
| JP | 2009-090264 | A | 4/2009 |
| JP | 2015-020161 | A | 2/2015 |

OTHER PUBLICATIONS

EPO, European Search Report for the corresponding European patent application No. 18903203.0, dated Sep. 14, 2021.

PCT, International Search Report for the corresponding patent application No. PCT/JP2018/046178, dated Mar. 19, 2019, with English translation.

PCT, Written Opinion of the International Searching Authority for the corresponding patent application No. PCT/JP2018/046178, dated Mar. 19, 2019.

JPO, Office Action for the corresponding Japanese patent application No. 2019-568920, dated May 17, 2022, with English translation.

CNIPA, Office Action for the corresponding Chinese patent application No. 201880085552.3, dated Jan. 27, 2022, with English translation.

CNIPA, Office Action for the corresponding Chinese patent application No. 201880085552.3, dated Jun. 13, 2022, with English translation.

* cited by examiner

DISCHARGE DEVICE AND LIQUID SUPPLY METHOD

CROSS REFERENCE TO RELATED APPLICATION

This Application is a 371 of PCT/JP2018/046178 filed on Dec. 14, 2018 which, in turn, claimed the priority of Japanese Patent Application No. 2018-017331 filed on Feb. 2, 2018, both applications are incorporated herein by reference.

TECHNICAL FIELD

The present invention relates to a discharge device which discharges a viscous material, and a liquid supply method for supplying the viscous material to the discharge device.

BACKGROUND

In the related art, there has been known a discharge device (for example, see Patent Literature 1 below). The discharge device is used for applying a viscous material to a predetermined applying target (workpiece). Generally, the discharge device includes a cylinder which is filled with a viscous material, a plunger which moves back and forth in the cylinder, a ball screw (feed screw) which is connected to the plunger, and a motor which is connected to the ball screw through a power transmission mechanism such as a gear. In the discharge device described in Patent Literature 1, when the viscous material is applied to the target, the power transmission mechanism is driven by the motor to integrally move the ball screw and the plunger back and forth.

In the above-mentioned discharge device, by advancing the plunger in the cylinder, the inside of the cylinder is pressurized to feed the viscous material into the nozzle and to discharge the viscous material from the nozzle. Further, in the above-mentioned discharge device, when the material is supplied into the cylinder, the viscous material is supplied from the supply source (for example, a liquid supply pump) while the plunger is retreated in the cylinder, whereby the viscous material is supplied into the cylinder.

CITATION LIST

Patent Literatures

Patent Literature 1: JP 2007-222768 A

SUMMARY OF INVENTION

Technical Problem

In the above-mentioned discharge device, when the viscous material is supplied into the cylinder, it is necessary to interlock the retreat of the plunger with the operation of the supply source. Therefore, it is necessary to strictly synchronize the amount (filling amount per unit time) of the viscous material filled in the cylinder with the speed at which the plunger is retreated in the cylinder. The control of the operation of the plunger when the viscous material is supplying, is considerably complicated.

The present invention has been made in view of the above problems, and an object of the invention is to provide a discharge device capable of easily controlling an operation of a plunger at the time of supplying a viscous material to a cylinder and a liquid supply method capable of forming a desired overlap portion.

Solution to Problem

A discharge device according to an embodiment of the present invention is a discharge device which discharges a viscous material from a nozzle communicating with a cylinder by pressurizing the viscous material supplied to the cylinder. The discharge device includes: a supply valve which controls a supply of the viscous material to the cylinder; a plunger which applies a pressure to the viscous material supplied to the cylinder; a ball screw which is movable in a same direction as a back-and-forth direction of the plunger; and a motor which is connected to the ball screw through a power transmission mechanism. The plunger and the ball screw are not connected.

A liquid supply method according to the present invention is a liquid supply method for supplying a viscous material to a discharge device for discharging the viscous material. The discharge device includes a supply valve which controls a supply of the viscous material to the cylinder, a plunger which applies a pressure to the viscous material supplied to the cylinder, a ball screw which is movable in a same direction as a back-and-forth direction of the plunger, and a motor which is connected to the ball screw through a power transmission mechanism, and the plunger and the ball screw are not connected. The liquid supply method includes: supplying the viscous material by opening the supply valve in a state where the ball screw moves in a direction apart from the plunger before the viscous material is supplied to the cylinder.

Advantageous Effects of Invention

According to the above discharge device, the ball screw connected to the motor through the power transmission mechanism is not connected to the plunger. Then, when the viscous material is supplied into the cylinder, the plunger retreats in the cylinder due to the pressurization by the viscous material supplied into the cylinder. Therefore, the discharge device does not need to strictly synchronize the amount (filling amount per unit time) of the viscous material filled in the cylinder with the speed at which the plunger is retreated in the cylinder, and thus the operation control of the plunger is facilitated.

Further, according to the above-described liquid supply method, the plunger moves to a position in contact with the ball screw in accordance with the supply of the viscous material into the cylinder, and advances in the cylinder in linkage with the advance of the ball screw at the time of starting discharging the viscous material. Therefore, in the discharge device in which the plunger and the ball screw are not connected, the advance of the ball screw and the advance of the plunger can be appropriately synchronized when the discharge of the viscous material is started, and thus it is possible to form a desired overlap portion (the overlapping portion of the initial applying portion and the final applying portion of the viscous material).

DESCRIPTION OF EMBODIMENTS

Figure 1:
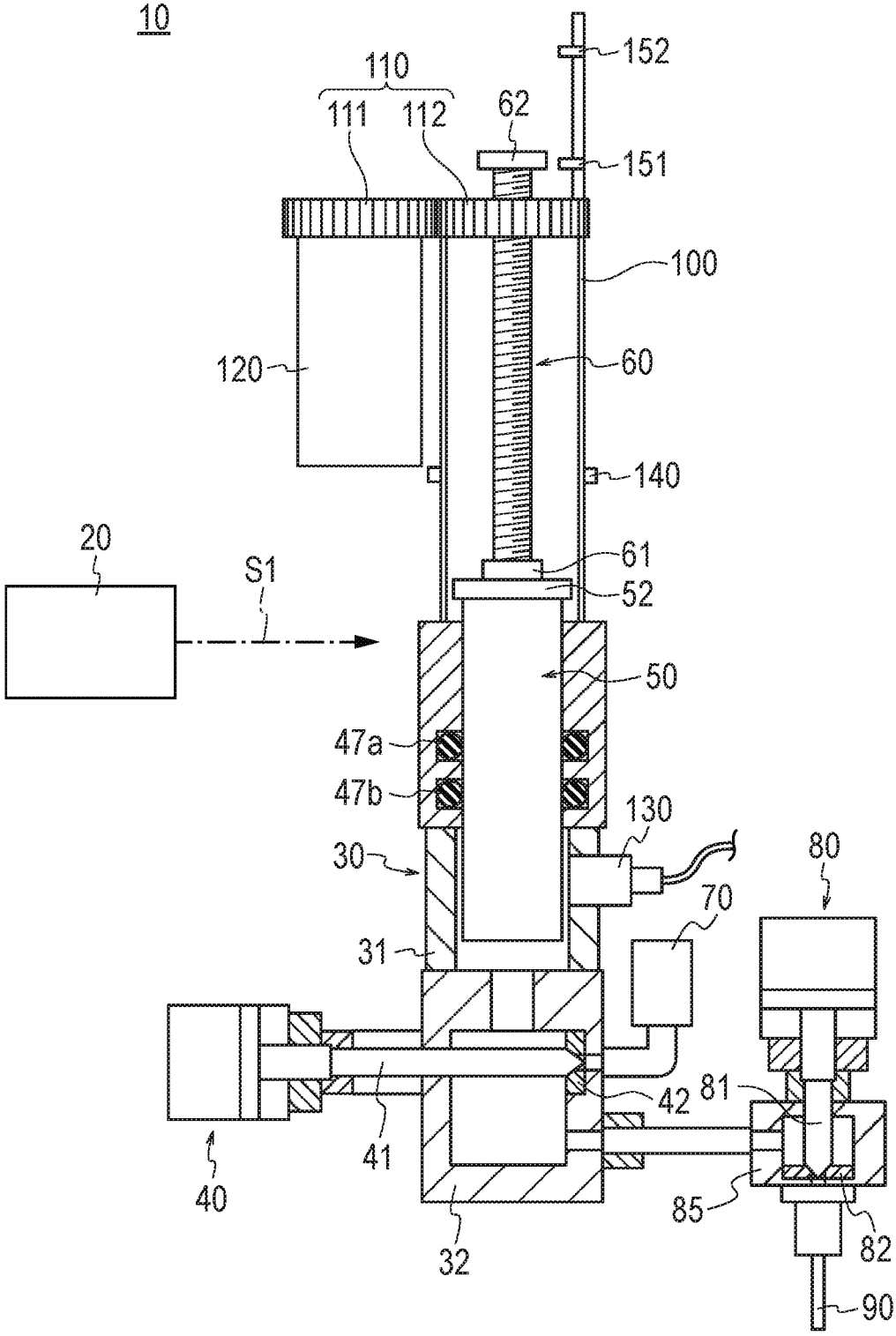
FIG. 1 is a view schematically illustrating an overall configuration of a discharge device according to an embodiment.

Hereinafter, embodiments of the present invention will be described with reference to the accompanying drawings. Note that, in the description of the drawings, the same elements are denoted by the same reference numerals, and redundant description is omitted. In addition, the dimensional ratios in the drawings are exaggerated for convenience of description, and may be different from the actual ratios.

FIGS. 1 to 8 are views for describing a discharge device 10 according to this embodiment and a discharge method of a viscous material M by the discharge device 10. Incidentally, FIGS. 2 to 8 illustrate a procedure of performing liquid supply or the like when the viscous material M is discharged after the initial liquid supply. FIG. 9 is a flowchart illustrating each step of the discharge method of the viscous material M according to the embodiment.

Figure 8:
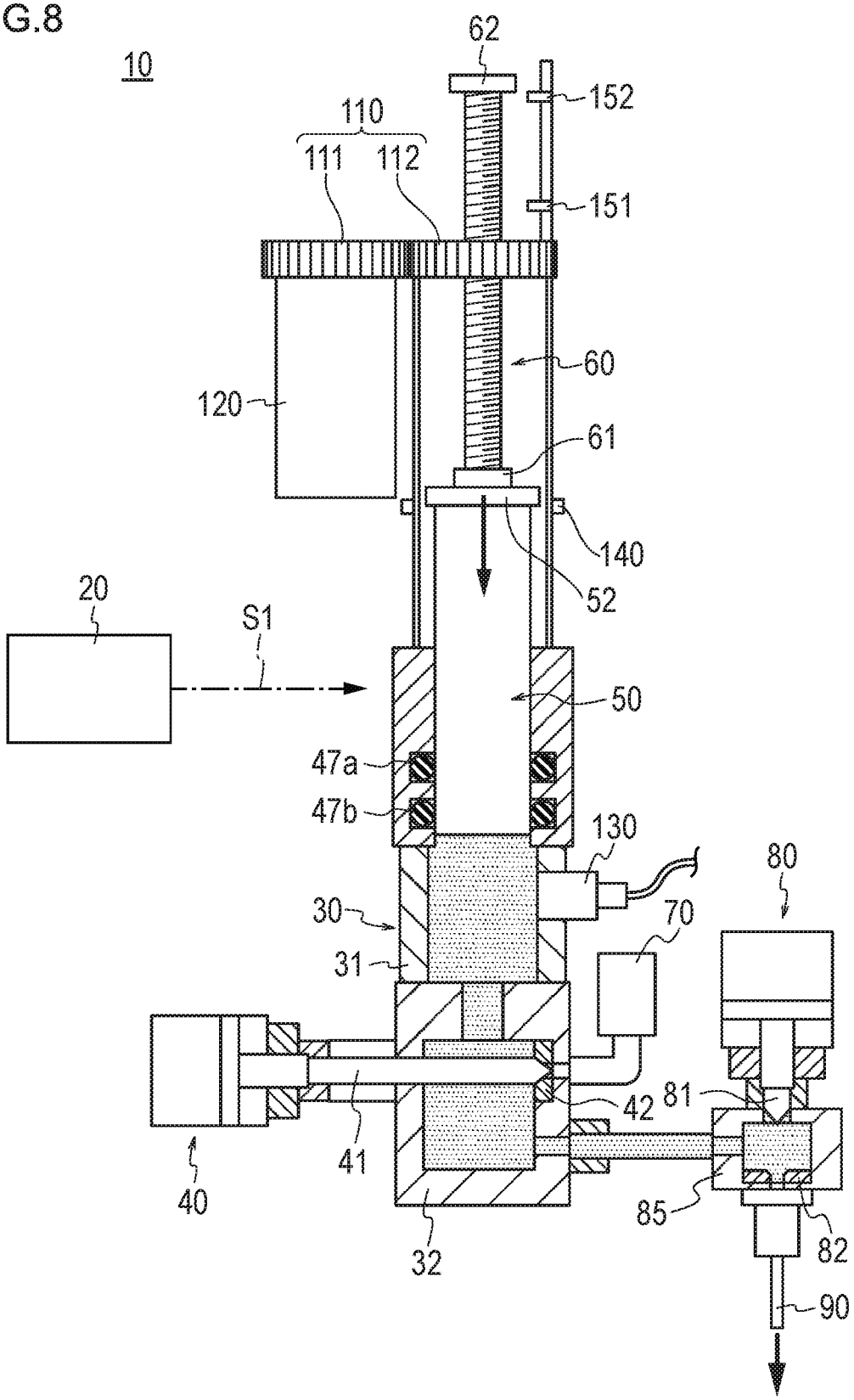
FIG. 8 is a view illustrating the discharge device in the state of discharging a viscous material.
Figure 9:
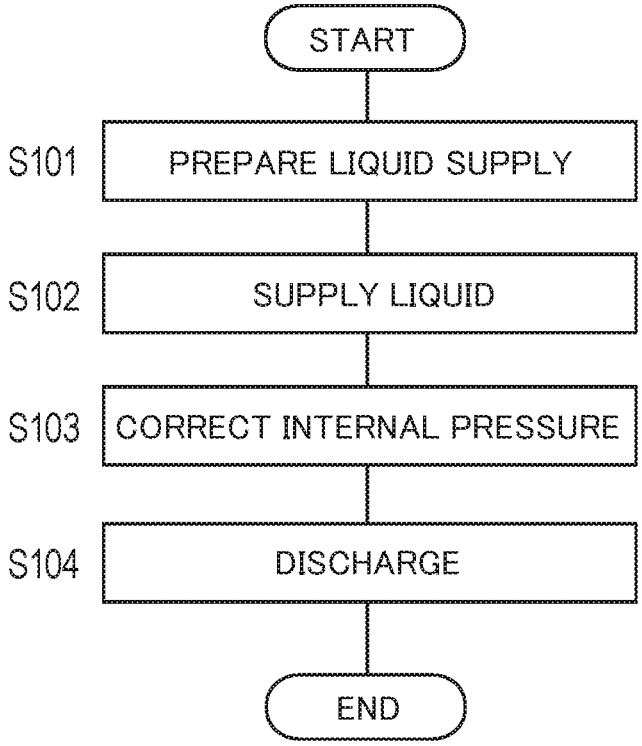
FIG. 9 is a flowchart illustrating each step of a discharge method according to the embodiment.

The discharge device 10 according to this embodiment is a device which discharges the viscous material M supplied to a cylinder 30 from a nozzle 90 and applies the discharged viscous material M to a predetermined applying target such as workpiece (see FIG. 8). The viscous material M is not particularly limited, and examples thereof include high-viscosity viscous materials such as reactive silicone, urethane resin, and epoxy resin. Further, the applying target is not particularly limited, and examples thereof include the joint surfaces of various flanges and screws of transportation equipment and industrial equipment.

Referring to FIG. 1 for an overview, the discharge device 10 includes a control unit 20 which controls the operation of the discharge device 10, a supply valve 40 which controls the supply of the viscous material M to the cylinder 30, a plunger 50 which applies a pressure to the viscous material M supplied to the cylinder 30, a ball screw 60 which is movable in the same direction as a back-and-forth direction of the plunger 50, and a motor 120 which is connected to the ball screw 60 through a power transmission mechanism 110.

In the discharge device 10, when the plunger 50 is advanced (move downward in FIGS. 1 to 8, hereinafter, also referred to as "lowered") in the cylinder 30 in a state where the viscous material M is supplied into the cylinder 30, the viscous material M is discharged through the nozzle 90 communicating with the cylinder 30. The viscous material M discharged from the nozzle 90 is applied on the applying target (not illustrated).

The cylinder 30 can store the viscous material M in the internal space of the cylinder 30. The cylinder 30 includes a first chamber 31 including an internal space in which the plunger 50 moves back and forth and a second chamber 32 arranged on a side closer than the first chamber 31 in a forward direction of the plunger 50.

As illustrated in FIG. 1, a pressure sensor 130 for detecting the pressure of the viscous material M filled in the cylinder 30 is arranged in the first chamber 31. The type, structure, arrangement, and the like of the pressure sensor 130 are not particularly limited as long as the pressure of the viscous material M in the cylinder 30 can be detected (measured).

Bearings 47*a* and 47*b* of the plunger 50 are arranged in the internal space of the first chamber 31. As the bearings 47*a* and 47*b*, for example, a known O-ring made of a resin material or the like can be used.

A valve rod 41 included in the supply valve 40 is arranged in the second chamber 32. The second chamber 32 communicates with the liquid supply pump 70 through a material supply passage. The liquid supply pump 70 can be configured by, for example, a known fluid pump which can pressure-feed the viscous material M.

When the supply of the viscous material M to the cylinder 30 is stopped (limited), a valve rod 41 of the supply valve 40 is seated on a valve seat 42 arranged in the second chamber 32 (for example, the state of FIG. 1). When the valve rod 41 of the supply valve 40 is seated on the valve seat 42, the communication between the liquid supply pump 70 and the second chamber 32 is interrupted. On the other hand, the supply valve 40 separates the valve rod 41 from the valve seat 42 when the viscous material M is supplied to the cylinder 30 (for example, the state of FIG. 4). When the valve rod 41 is separated from the valve seat 42, the liquid supply pump 70 and the second chamber 32 communicate with each other, and thus the viscous material M can be supplied to the second chamber 32.

As illustrated in FIG. 1, the second chamber 32 of the cylinder 30 communicates with the discharge chamber 85 through a material supply passage. The nozzle 90 is attached to the discharge chamber 85. The internal space of the discharge chamber 85 and the flow path (not illustrated) formed in the nozzle 90 communicate with each other.

The discharge device 10 includes a discharge valve 80 which controls the discharge of the viscous material M from the nozzle 90. A valve rod 81 included in the discharge valve 80 is arranged in the discharge chamber 85. When the discharge of the viscous material M through the nozzle 90 is stopped (limited), the valve rod 81 of the discharge valve 80 is seated on the valve seat 82 arranged in the discharge chamber 85 (for example, the state of FIG. 1). Further, when the viscous material M is discharged through the nozzle 90, the discharge valve 80 separates the valve rod 81 from the valve seat 82 (for example, the state of FIG. 8). When the valve rod 81 is separated from the valve seat 82, the discharge chamber 85 and the internal flow path of the nozzle 90 communicate with each other, and thus the viscous material M can be discharged through the nozzle 90.

The motor 120 included in the discharge device can be configured by, for example, a known stepping motor. The motor 120 rotationally drives the power transmission mechanism 110, thereby moving the ball screw 60 connected to the power transmission mechanism 110 back and forth.

The power transmission mechanism 110 includes a drive gear 111 connected to the motor 120, and a driven gear 112 engaging with the drive gear 111. The drive gear 111, for example, can be connected to the motor 120 through a clutch mechanism (not illustrated).

The driven gear 112 is engaged with the ball screw 60. When the motor 120 rotationally drives the drive gear 111, the driven gear 112 rotates in association with the rotation of the drive gear 111, and the ball screw 60 also rotates. In the discharge device 10, when the motor 120 is operated to rotate (for example, normally rotate) the ball screw 60 in one rotation direction, the ball screw 60 can be advanced toward the cylinder 30. Further, in the discharge device 10, when the motor 120 is operated to rotate (for example, reversely rotate) the ball screw 60 in another rotation direction, the ball screw 60 can be moved (move upward in FIGS. 1 to 8, hereinafter, also referred to as "raise") from the cylinder 30 in a retreating direction.

Figure 2:
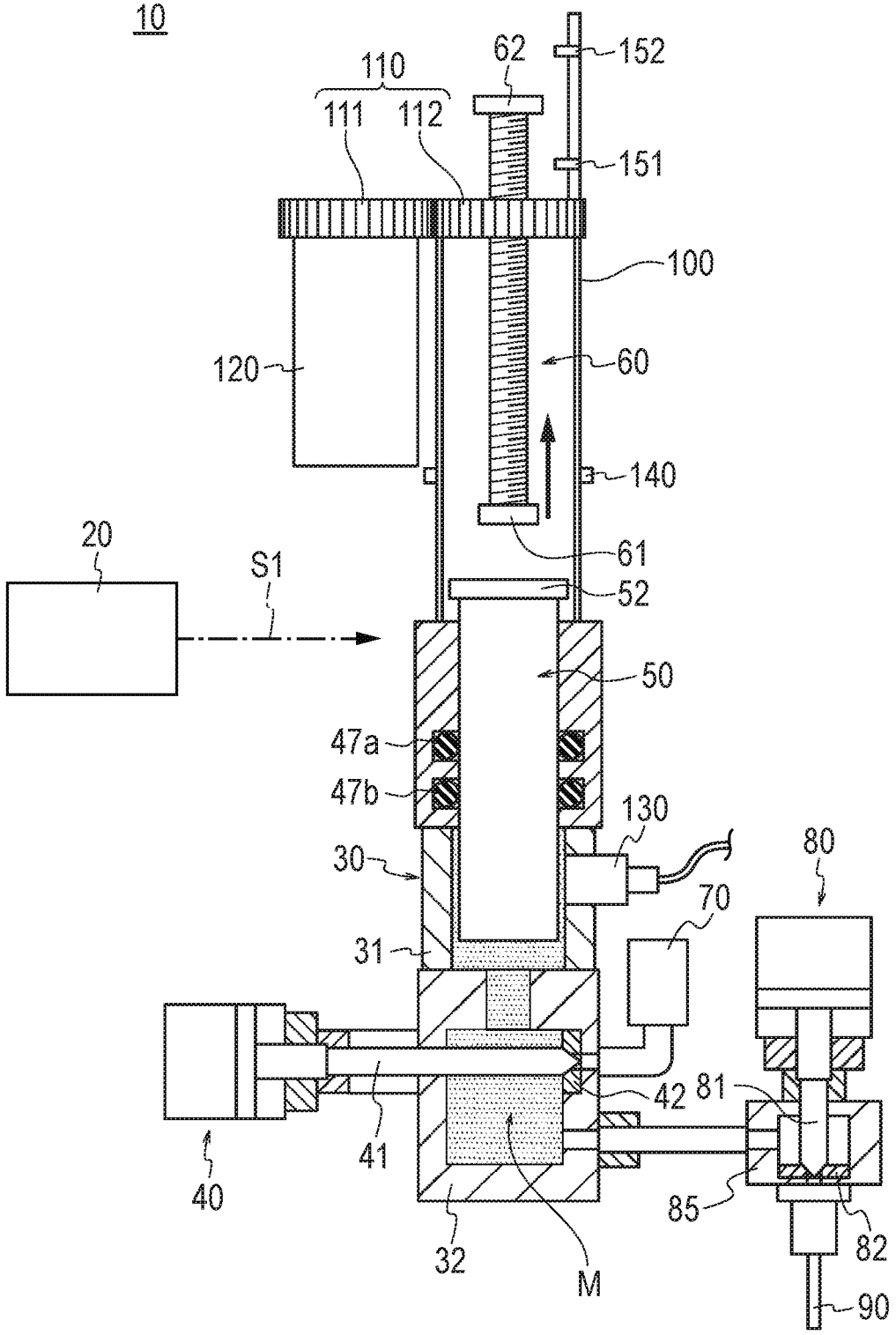
FIG. 2 is a view illustrating the discharge device in the state of performing preparation for liquid supply.

In the discharge device 10 according to this embodiment, the ball screw 60 and the plunger 50 are not connected. In other words, the ball screw 60 and the plunger 50 are not connected to each other through a mechanical connection structure for integrally moving the ball screw and the plunger back and forth. Therefore, the ball screw 60 can move back and forth independently of the plunger 50. For example, as illustrated in FIG. 2, in the discharge device 10, when the ball screw 60 is retreated independently to the plunger 50, a lower end 61 of the ball screw 60 can be arranged at a position separated from an upper end 52 of the plunger 50.

By moving the plunger 50 forward in the cylinder 30, the plunger 50 pressurizes the viscous material M supplied into the cylinder 30 to pressure-feed the viscous material M to the nozzle 90.

Figure 3:
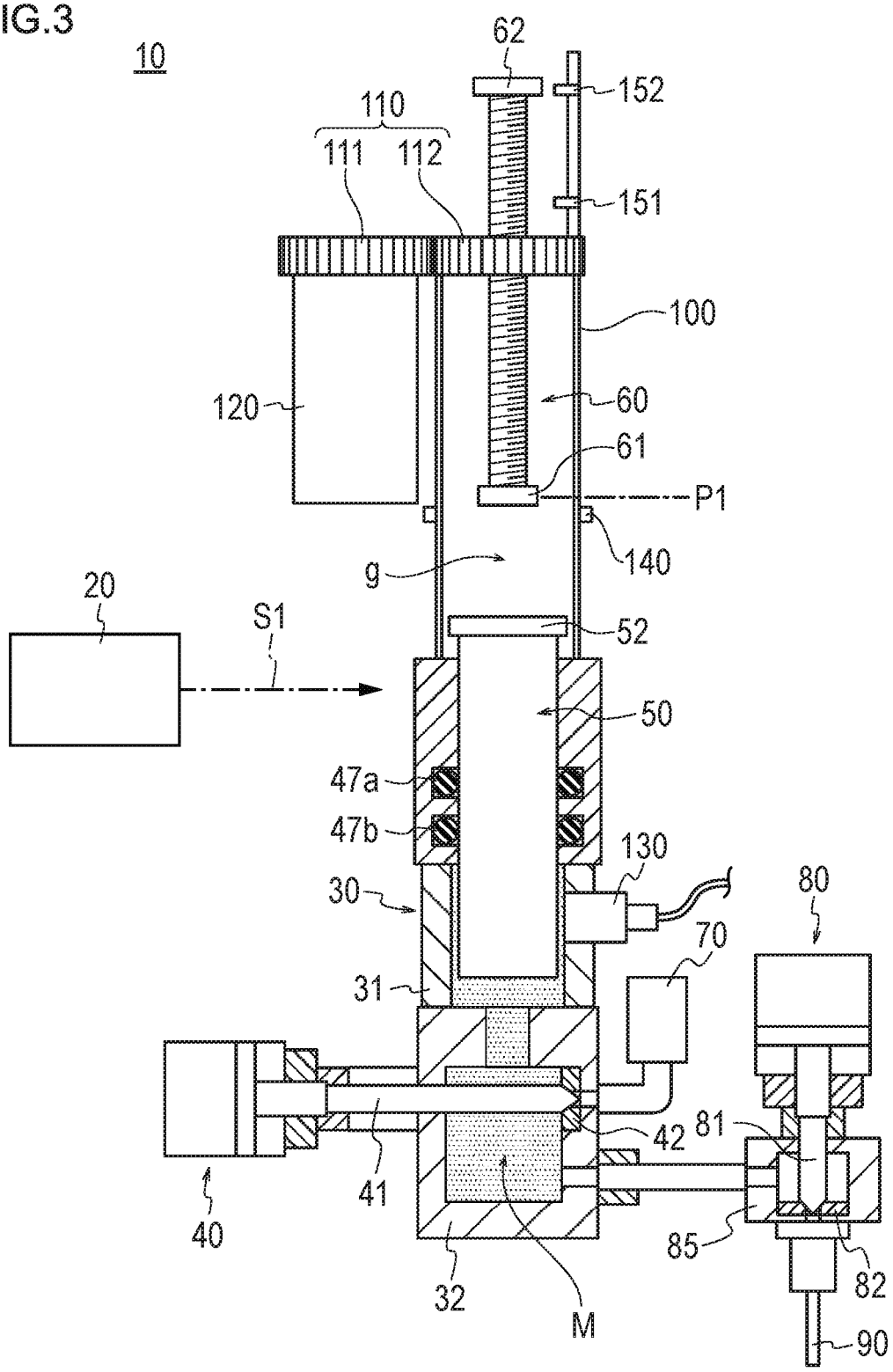
FIG. 3 is a view illustrating the discharge device in the state of performing the preparation for liquid supply.
Figure 4:
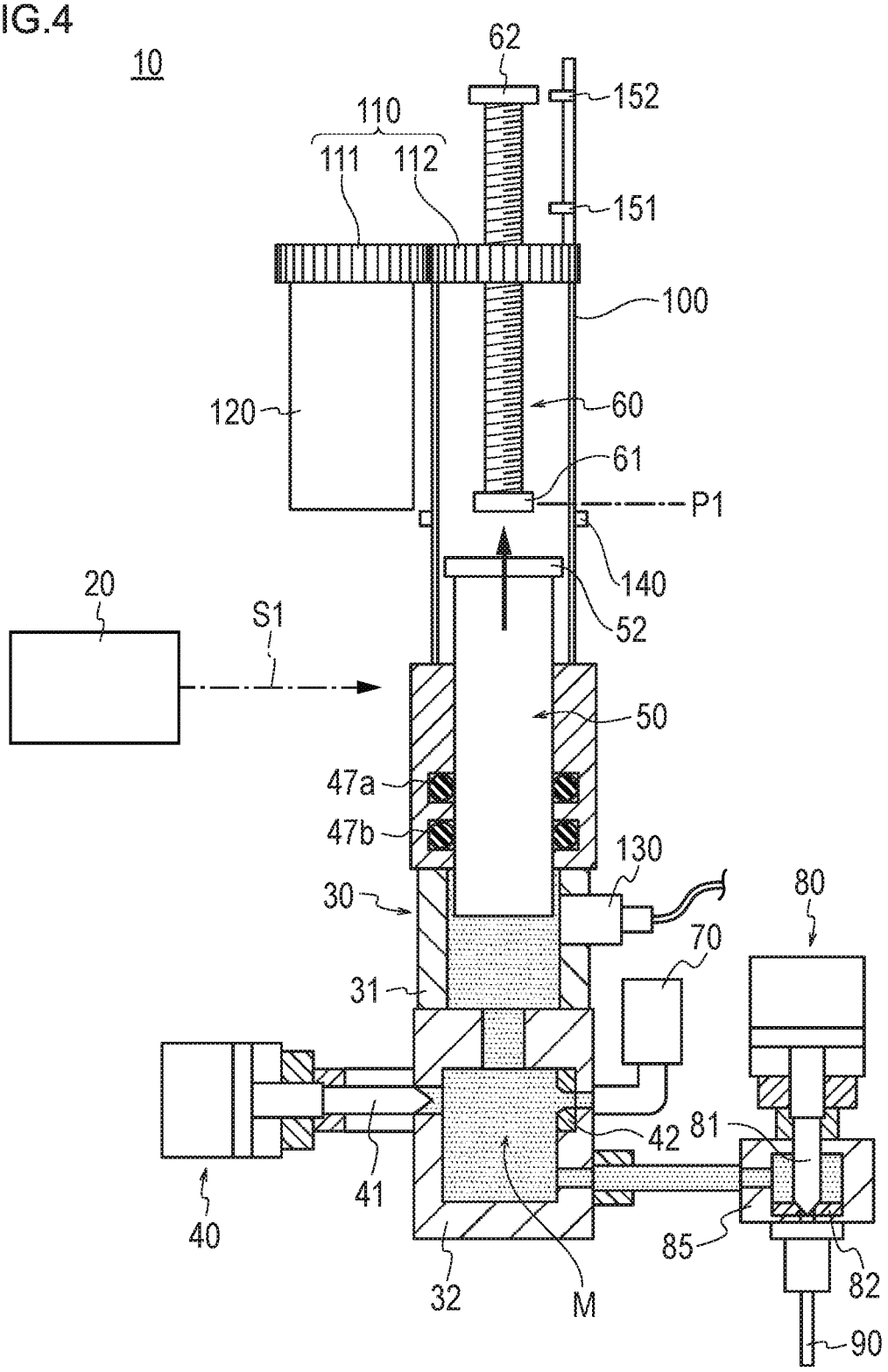
FIG. 4 is a view illustrating the discharge device in the state of performing liquid supply.

As illustrated in FIG. 8, in the discharge device 10, when the ball screw 60 is normally rotated at the time of advancing the plunger 50, the lower end 61 of the ball screw 60 is brought into contact with and presses the upper end 52 of the plunger 50. Further, as illustrated in FIG. 3, in the discharge device 10, when the plunger 50 is retreated, the ball screw 60 is arranged at a predetermined position P1 apart from the plunger 50, and a gap (space) g is formed between the lower end 61 of the ball screw 60 and the upper end 52 of the plunger 50. As illustrated in FIG. 4, the discharge device 10 supplies the viscous material M into the cylinder 30 in a state where the gap g is formed and increases the internal pressure of the cylinder 30. The plunger 50 rises in the cylinder 30 so as to approach the ball screw 60 as the internal pressure of the cylinder 30 increases.

As illustrated in FIG. 1, the cylinder 30 includes a support member 100 attached a photoelectric sensor 140. As the support member 100, for example, a rod-shaped member made of a metal material such as aluminum can be used.

The discharge device 10 includes a photoelectric sensor 140 arranged in the support member 100 included in the cylinder 30. As the photoelectric sensor 140, for example, a known photoelectric sensor such as a transmissive sensor, a retroreflective sensor, or a diffuse reflective sensor can be used. In particular, it is preferable to use a transmissive photoelectric sensor. Further, for example, the photoelectric sensor 140 can be arranged in the support member 100 so that the detection light is emitted from the support member 100 side to the ball screw 60 side.

Figure 5:
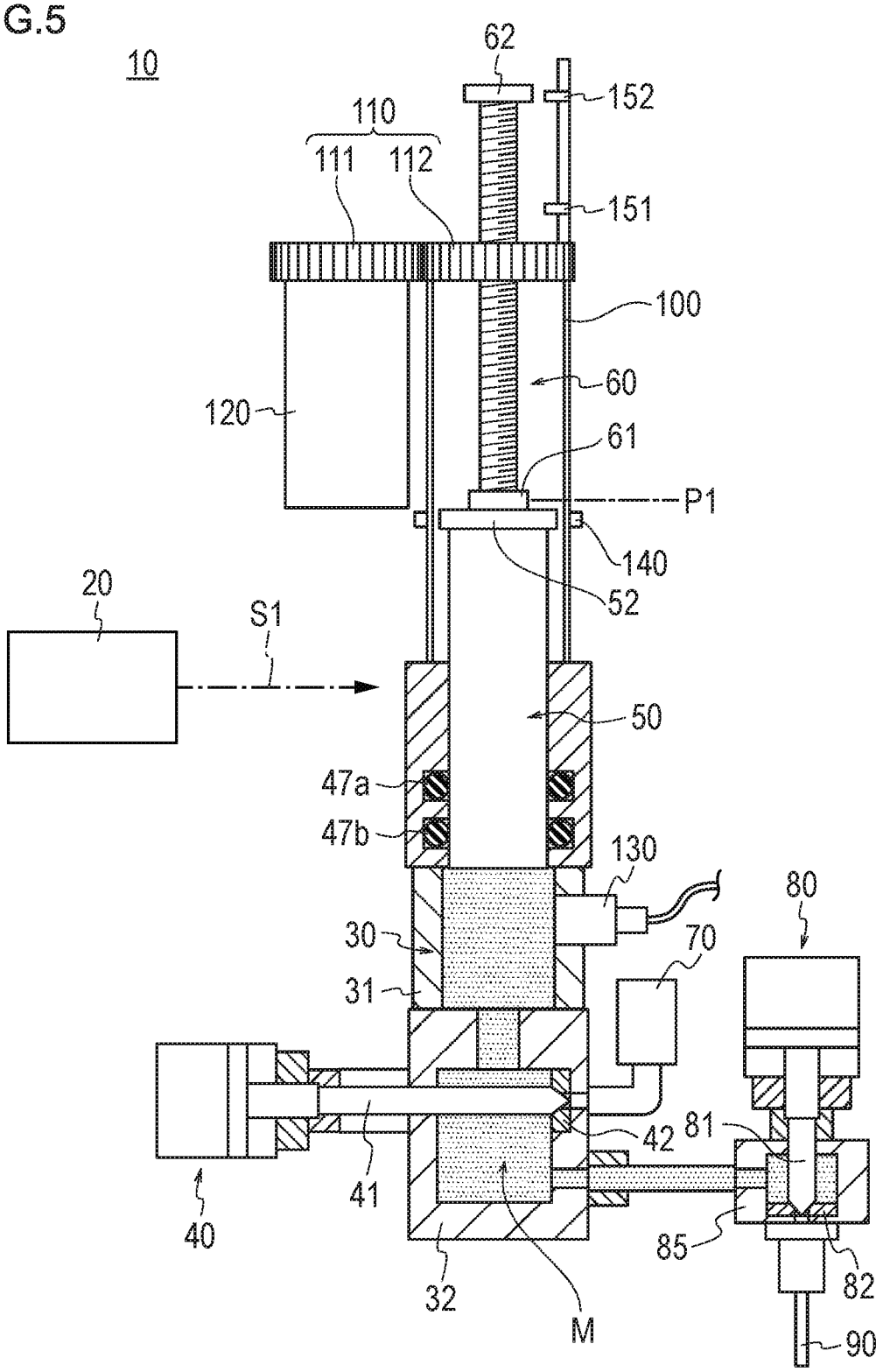
FIG. 5 is a view illustrating the discharge device in the state of completing the liquid supply.

The photoelectric sensor 140 is used to detect whether or not the viscous material M is filled in the cylinder 30 to the maximum extent. For example, the photoelectric sensor 140 detects the position of the upper end 52 of the plunger 50 as illustrated in FIG. 5.

In this embodiment, the maximum filling amount of the viscous material M in the cylinder 30 can be defined as a movement amount of the plunger 50 to the position which the upper end 52 of the plunger 50 is in contact with the lower end 61 of the ball screw 60 when the ball screw 60 is retreated to the predetermined position P1. That is, the maximum filling amount of the viscous material M in the cylinder 30 is the empty volume of the cylinder 30 corresponding to the upward movable amount of the plunger 50 in a state where the lower end 61 of the ball screw 60 is separated from the upper end 52 of the plunger 50. Therefore, as illustrated in FIG. 5, by detecting the position where the upper end 52 of the plunger 50 is brought into contact with the lower end 61 of the ball screw 60, the photoelectric sensor 140 can detect whether or not the viscous material M is filled in the cylinder 30 to the maximum extent.

As illustrated in FIG. 1, the discharge device includes a forward position detection sensor 151 which detects whether or not the ball screw 60 reaches to a forward position which is positioned in the plunger 50 side by a predetermined distance, a backward position detection sensor 152 which detects whether or not the ball screw 60 reaches to a back ward position which is positioned by a predetermined distance from the plunger 50.

The forward position detection sensor 151 and the backward position detection sensor 152 are arranged at a predetermined interval in the back-and-forth direction (the vertical direction in FIG. 1) of the ball screw 60. Further, the backward position detection sensor 152 is arranged on a side (upper side in the drawing) closer than the forward position detection sensor 151 in a backward direction of the ball screw 60. The forward position detection sensor 151 and the backward position detection sensor 152 can be arranged, for example, on the upper end side of the support member 100 to which the photoelectric sensor 140 is attached.

As illustrated in FIG. 1, the forward position detection sensor 151 detects the position of the upper end 62 of the ball screw 60 and detects the distance where the ball screw 60 advances with respect to the plunger 50. Specifically, the forward position detection sensor 151 detects that the plunger 50 advances by the distance between the forward position detection sensor 151 and the backward position detection sensor 152. For example, the forward position detection sensor 151 can be arranged so as to detect the forward position of the ball screw 60 at which the discharge amount of the viscous material M through the nozzle 90 reaches a desired amount.

As illustrated in FIG. 3, the backward position detection sensor 152 detects the position of the upper end 62 of the ball screw 60 and detects the distance where the ball screw 60 retreats with respect to the plunger 50. Specifically, the backward position detection sensor 152 detects that the plunger 50 retreats by the distance between the forward position detection sensor 151 and the backward position detection sensor 152. For example, the backward position detection sensor 152 can be arranged so as to detect the predetermined position P1 of the ball screw 60 at which the filling amount of the viscous material M in the cylinder 30 is maximum.

As the forward position detection sensor 151 and the backward position detection sensor 152, for example, known transmissive or reflective photosensors can be used. However, the type, structure, arrangement, and the like of the sensors 151 and 152 are not particularly limited as long as the position of the ball screw 60 can be detected.

For example, the control unit 20 can be configured by a known PC including a CPU, a memory, an input/output interface, and the like. The control unit transmits and receives various control signals S1 and executes the operation control of each of the sensors 130, 140, 151, and 152, the operation control of the motor 120, the operation control of each of the valves 40 and 80, the operation control of the liquid supply pump 70, and the like.

Next, the discharge method of the viscous material M according to this embodiment will be described.

As illustrated in FIG. 9, the discharge method of the viscous material M generally includes liquid supply preparation (S101), liquid supply (S102), internal pressure correction (S103), and discharge (S104). Hereinafter, the discharge method will be described in detail.

FIG. 1 illustrates the discharge device 10 before the viscous material M is supplied into the cylinder 30. The supply valve 40 and the discharge valve 80 are closed as illustrated in FIG. 1 in the state before the liquid supply and the discharge.

When the viscous material M is supplied, the discharge device 10 prepares the liquid supply. Specifically, the discharge device 10 raises the ball screw 60 (retreats from the plunger 50) as illustrated in FIG. 2. As illustrated in FIG. 3, the discharge device 10 raises the ball screw 60 until the lower end of the ball screw 60 reaches the predetermined position P1. When the lower end 61 of the ball screw 60 reaches the predetermined position P1, the gap g is formed between the lower end 61 of the ball screw 60 and the upper end 52 of the plunger 50. Whether or not the lower end 61 of the ball screw 60 reaches the predetermined position P1 can be confirmed by detecting the upper end 62 of the ball screw 60 by the backward position detection sensor 152.

Incidentally, in this embodiment, the supply of the viscous material M is started in a state where the lower end 61 of the ball screw 60 reaches the predetermined position P1. However, for example, the liquid supply of the viscous material M to the cylinder and the movement of the ball screw 60 may be executed in parallel. In such a case, for example, the timing at which the liquid supply of the viscous material M is started can be set to substantially the same as the timing at which the ball screw 60 rises (reversely rotate), for example, the timing of starting in parallel without a time difference in operation control. As described above, "the state in which the ball screw starts moving toward a predetermined position" may be any one of a state at the same time as the timing when the ball screw 60 starts moving or a state where a predetermined time has elapsed after the ball screw 60 starts moving.

The rising speed of the plunger 50 depends on the viscosity of the viscous material M. Meanwhile, since the ball screw 60 is not connected to the plunger 50, the ball screw 60 can be raised independently. Therefore, the discharge device 10 does not need to strictly synchronize the rising speed of the ball screw 60 and the rising speed of the plunger 50.

Next, as illustrated in FIG. 4, the discharge device 10 starts the liquid supply. The discharge device 10 opens the supply valve 40. The discharge device 10 operates the liquid supply pump 70 to supply the viscous material M to the cylinder 30. The plunger rises toward the ball screw 60 when the internal pressure of the cylinder 30 increases with the supply of the viscous material M into the cylinder 30. Therefore, the discharge device 10 does not need to strictly control the moving speed of the plunger 50 so as to follow the increase in the liquid supply amount of the viscous material M into the cylinder 30.

Incidentally, if the rise of the ball screw 60 and the rise of the plunger 50 are controlled according to the increase of the internal pressure of the cylinder while the internal pressure of the cylinder 30 is monitored, the following problems may occur. For example, when astringent (the bearings 47*a* and 47*b* are worn due to deterioration over time or the like, and the viscous material M leaks and hardens) occurs near the bearings 47*a* and 47*b*, a resistance which prevents the plunger 50 from rising is generated, and the ball screw 60 and the plunger 50 may be unintentionally arranged to be separated from each other in a stage where the liquid supply into the cylinder 30 is completed. In particular, in the discharge device 10, in a case where the liquid supply or the like is performed after a predetermined time has elapsed after the initial liquid supply, the resistance which prevents the movement of the plunger 50 is increased due to the effect of the hardening of the viscous material M (for example, in a case where the viscous material M is a moisture-curable material). As a result, when the discharge of the viscous material M by the discharge device 10 is started, a displacement occurs in the initial discharge position (initial applying position) depending on the distance between the ball screw 60 and the plunger 50, the discharge is delayed at the start of discharge, and a desired overlap portion is hardly formed.

As illustrated in FIG. 5, the plunger 50 rises until the upper end 52 of the plunger 50 is brought into contact with the lower end 61 of the ball screw 60. When the upper end 52 of the plunger 50 is in contact with the lower end 61 of the ball screw 60, the supply of the viscous material M to the cylinder 30 is stopped. That is, at this stage, the cylinder 30 is filled with the maximum amount of the viscous material M. The photoelectric sensor 140 detects whether or not the viscous material M is filled in the cylinder 30 to the maximum extent by detecting the position of the plunger 50.

Figure 6:
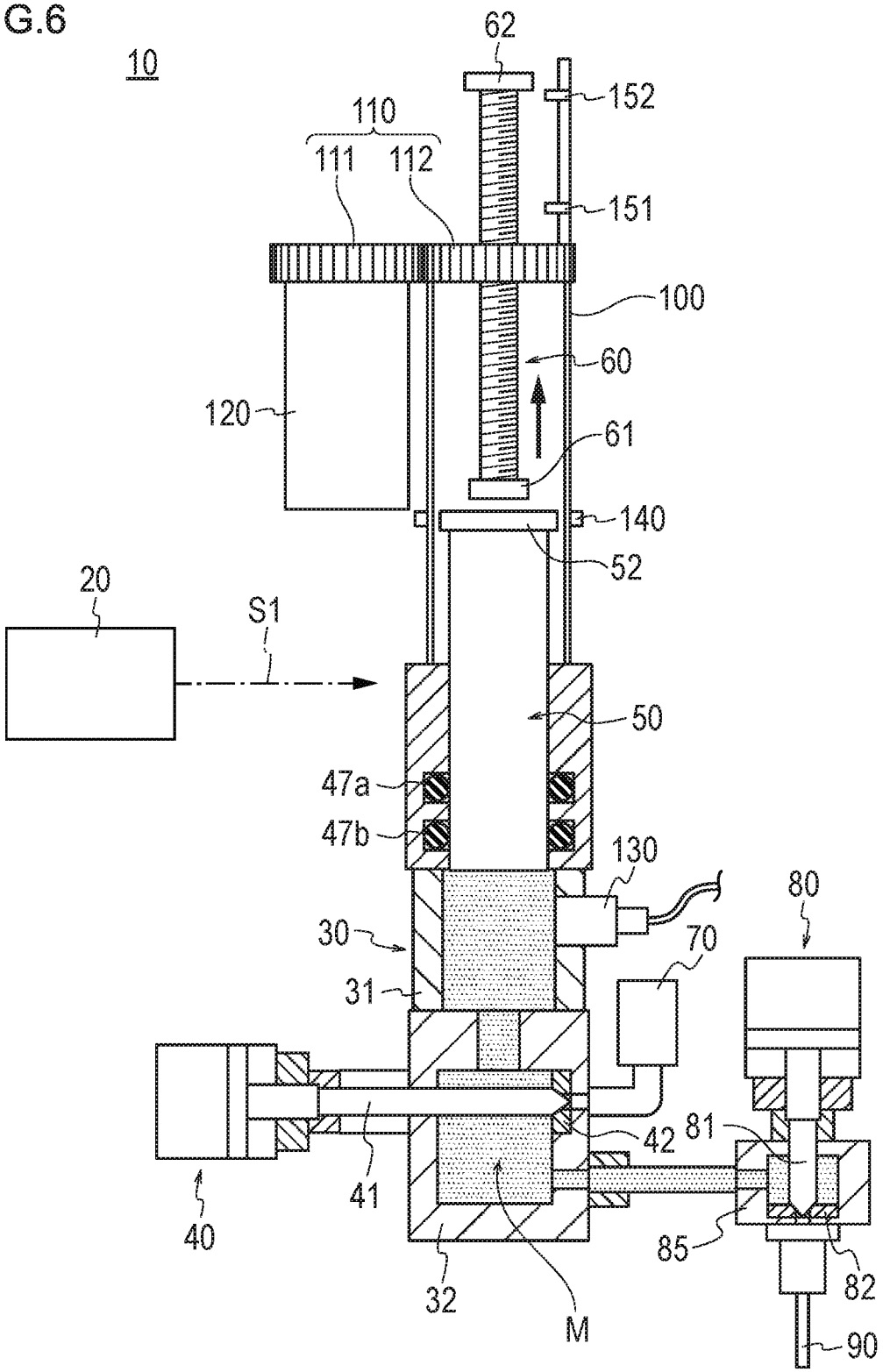
FIG. 6 is a view illustrating the discharge device in the state of performing internal pressure correction.
Figure 7:
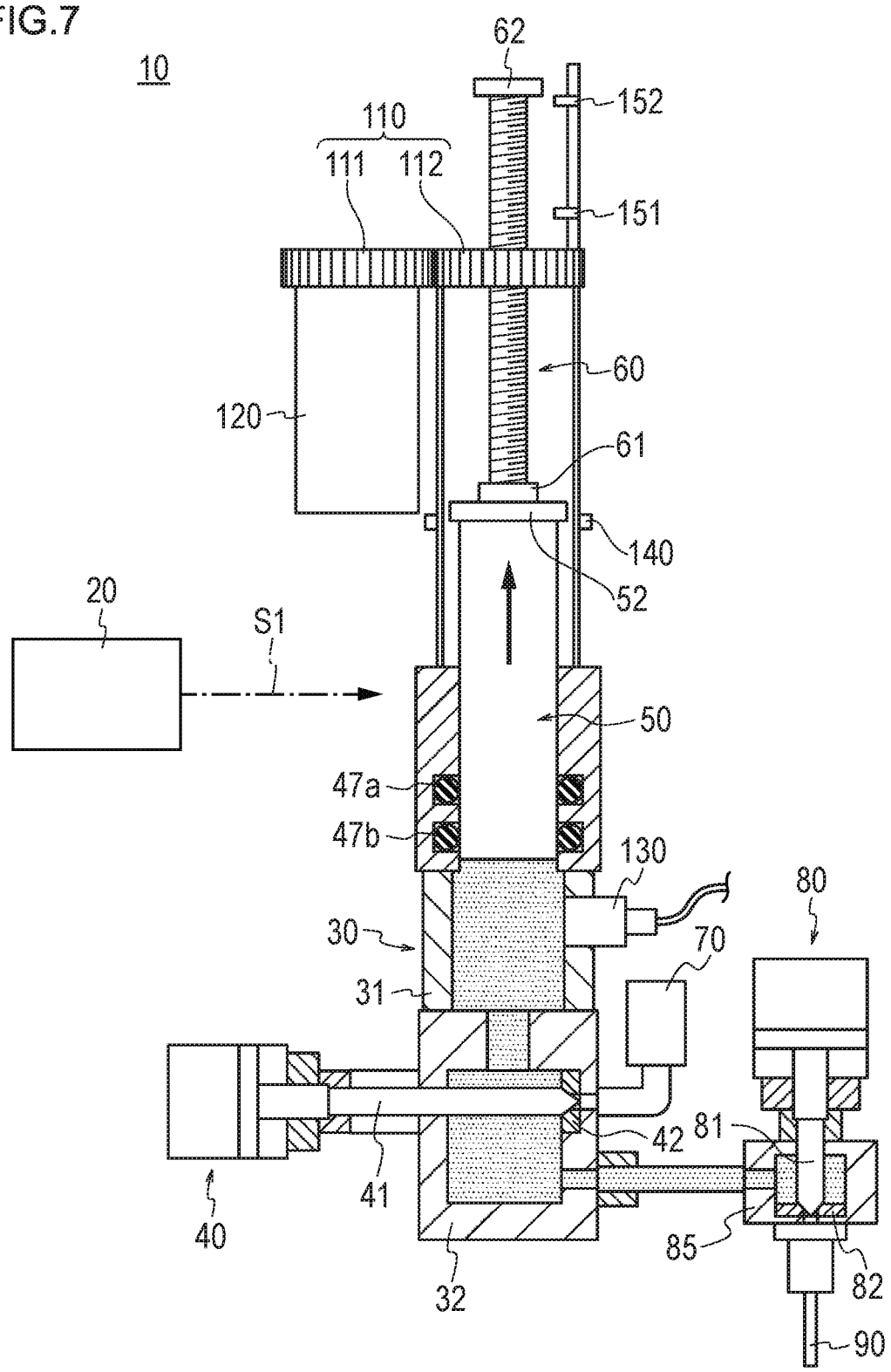
FIG. 7 is a view illustrating the discharge device in the state of performing the internal pressure correction.

Next, the discharge device 10 corrects the internal pressure of the cylinder 30. Specifically, as illustrated in FIG. 6, the discharge device 10 raises the ball screw 60 with the supply valve 40 and the discharge valve 80 closed. As illustrated in FIG. 7, the plunger 50 rises with the rise of the ball screw 60 by the internal pressure of the cylinder 30. As a result, the internal pressure of the cylinder 30 drops to a desired value. The pressure sensor 130 detects the internal pressure of the cylinder 30. Accordingly, the discharge device 10 can confirm that the internal pressure of the cylinder 30 is adjusted to the desired value before the discharge of the viscous material M is started.

Next, the discharge device 10 starts discharging the viscous material M. The discharge device 10 opens the discharge valve 80. Then, in the discharge device 10, when the ball screw 60 is lowered in a state where the lower end 61 of the ball screw 60 is in contact with the upper end 52 of the plunger 50 (abutted state), the plunger 50 can be lowered synchronously with the lowering of the ball screw 60. The viscous material M filled in the cylinder 30 is applied on a predetermined applying target through the nozzle 90. The discharge of the viscous material M is continued until, for example, the upper end 62 of the ball screw 60 is detected by the forward position detection sensor 151.

The effects of the discharge device 10 and the liquid supply method according to this embodiment will be described.

As described above, the discharge device 10 according to this embodiment is a device which discharges the viscous material M from the nozzle 90 communicating with the cylinder 30 by pressurizing the viscous material M supplied to the cylinder 30. The discharge device 10 includes the supply valve 40 which controls the supply of the viscous material M to the cylinder 30, the plunger 50 which applies a pressure to the viscous material M supplied to the cylinder 30, the ball screw 60 which is movable in the same direction as the back-and-forth direction of the plunger 50, and the motor 120 which is connected to the ball screw 60 through the power transmission mechanism 110. The plunger 50 and the ball screw 60 are not connected.

According to the discharge device 10, the ball screw 60 connected to the motor 120 through the power transmission mechanism 110 is not connected to the plunger 50. Then, when the viscous material M is supplied into the cylinder 30, the plunger 50 retreats in the cylinder 30 due to the pressurization by the viscous material M supplied into the cylinder 30. Therefore, the discharge device 10 does not need to strictly synchronize the amount (filling amount per unit time) of the viscous material M filled in the cylinder with the speed at which the plunger 50 is retreated in the cylinder 30, and thus the operation control of the plunger 50 is facilitated.

The supply valve 40 opens to supply the viscous material M to the cylinder 30 in a state where the ball screw 60 starts moving toward the predetermined position P1. Therefore, the viscous material M can be suitably supplied into the cylinder 30 without performing control for strictly synchronizing the moving speed of the ball screw 60 and the moving speed of the plunger 50.

The discharge device 10 moves the ball screw 60 and supplies the viscous material M in parallel. Therefore, the viscous material M can be efficiently supplied.

The discharge device 10 includes the photoelectric sensor 140 which is arranged in the cylinder 30 and detects whether or not the viscous material M is filled in the cylinder 30 to the maximum extent. Therefore, in the discharge device 10 where the plunger 50 is moved according to the increase in the internal pressure of the cylinder 30, the filling amount of the viscous material M into the cylinder 30 can be detected more accurately when the position of the plunger 50 is detected by the photoelectric sensor 140.

The discharge device 10 includes the forward position detection sensor 151 which detects whether or not the ball screw 60 reaches to a forward position which is positioned in the plunger 50 side by a predetermined distance, the backward position detection sensor 152 which detects whether or not the ball screw 60 reaches to a back ward position which is positioned by a predetermined distance from the plunger 50. Therefore, by detecting the position of the ball screw 60 by the sensors 151 and 152, the discharge device 10 can control the adjustment of the filling amount of the viscous material M into the cylinder 30 and the adjustment of the discharge amount of the viscous material M from the nozzle 90 more accurately.

The discharge device 10 includes the discharge valve 80 which controls the discharge of the viscous material M through the nozzle 90. Therefore, the discharge device 10 can appropriately switch the discharge of the viscous material M from the nozzle 90 and the restriction of the discharge by controlling the opening/closing of the discharge valve 80.

The discharge device 10 includes the pressure sensor 130 which detects the pressure of the viscous material M supplied into the cylinder 30. Therefore, in the discharge device 10, the internal pressure correction of adjusting the internal pressure of the cylinder 30 to the desired value before starting the discharge of the viscous material M can be performed by monitoring the internal pressure of the cylinder 30 by the pressure sensor 130.

The liquid supply method according to this embodiment is a liquid supply method of supplying the viscous material M to the discharge device 10. The discharge device 10 includes the supply valve 40 which controls the supply of the viscous material M to the cylinder 30, the plunger 50 which applies a pressure to the viscous material M supplied to the cylinder 30, the ball screw 60 which is movable in the same direction as the back-and-forth direction of the plunger 50, and the motor 120 which is connected to the ball screw 60 through the power transmission mechanism 110. Further, the plunger 50 of the discharge device 10 is not connected to the ball screw 60, and the viscous material M is supplied by opening the supply valve 40 in a state where the ball screw 60 starts moving.

According to the above-described liquid supply method, the plunger 50 moves to a position in contact with the ball screw 60 in accordance with the supply of the viscous material into the cylinder 30, and advances in the cylinder 30 in linkage with the advance of the ball screw 60 at the time of starting discharging the viscous material M. Therefore, in the discharge device in which the plunger 50 and the ball screw 60 are not connected, the advance of the ball screw 60 and the advance of the plunger 50 can be appropriately synchronized when the discharge of the viscous material M is started, and thus it is possible to form a desired overlap portion (the overlapping portion of the initial applying portion and the final applying portion of the viscous material).

In the liquid supply method, the photoelectric sensor 140 included in the discharge device 10 detects whether or not the viscous material M is filled in the cylinder 30 to the maximum extent. Therefore, in the liquid supply method, the filling amount of the viscous material M into the cylinder 30 can be detected more accurately when the position of the plunger 50 is detected by the photoelectric sensor 140 in the discharge device 10 in which the plunger 50 is moved according to the increase in the internal pressure of the cylinder 30.

Hereinbefore, the discharge device and the liquid supply method according to the present invention have been described above through the embodiments. However, the present invention is not limited to the contents described in the specification and may be appropriately modified on the basis of the description of the claims.

The specific configuration is not limited as long as the discharge device includes at least a supply valve, a plunger, a ball screw, and a motor, further the plunger is not connected to the ball screw. For example, the layout of the whole device, the specific structure, shape, and material of each member may be appropriately changed, and the addition or omission of a member may be appropriately performed.

The back-and-forth direction of the ball screw and the plunger is not limited to the vertical direction as described in the embodiment. The back-and-forth direction may be changed appropriately according to the device structure of the discharge device, the discharge direction of the viscous material, or the like.

This application is based on Japanese Patent Application No. 2018-017331 filed on Feb. 2, 2018, the contents of which are incorporated herein by reference.

REFERENCE SIGNS LIST

10 Discharge device
20 Control unit
30 Cylinder
40 Supply valve
41 Valve rod of supply valve
47*a*, 47*b* Bearing
50 Plunger
52 Upper end of plunger
60 Ball screw
61 Lower end of ball screw
62 Upper end of ball screw
70 Liquid supply pump

80 Discharge valve
81 Valve rod of discharge valve
90 Nozzle
100 Support member
110 Power transmission mechanism
111 Drive gear
112 Driven gear
120 Motor
130 Pressure sensor
140 Photoelectric sensor
151 Forward position detection sensor
152 Backward position detection sensor
M Viscous material
g Gap

What is claimed is:

1. A discharge device which discharges a viscous material from a nozzle communicating with a cylinder by pressurizing the viscous material supplied to the cylinder, the device comprising:

a supply valve which controls a supply of the viscous material to the cylinder;

a plunger which applies a pressure to the viscous material supplied to the cylinder;

a ball screw which is movable in a same direction as a back-and-forth direction of the plunger;

a motor which is connected to the ball screw through a power transmission mechanism; and a pressure sensor which is arranged in the cylinder and detects a pressure of the viscous material supplied into the cylinder, wherein the discharge device performs correcting an internal pressure by raising the ball screw, while the supply valve is closed, to drop the internal pressure of the cylinder to a desired value after the viscous material is supplied to the cylinder, the pressure sensor monitors the internal pressure of the cylinder after the discharge device performs correcting the internal pressure, and the plunger and the ball screw are not connected.

2. The discharge device according to claim 1, wherein the supply valve opens to supply the viscous material to the cylinder in a state where the ball screw starts moving toward a predetermined position.

3. The discharge device according to claim 2, wherein the movement of the ball screw and the supply of the viscous material are performed in parallel.

4. The discharge device according to claim 1, comprising:

a photoelectric sensor which detects whether or not the viscous material is filled in the cylinder to a maximum extent.

5. The discharge device according to claim 1, comprising:

a forward position detection sensor which detects whether or not the ball screw reaches to a forward position which is positioned in the plunger side by a predetermined distance; and a backward position detection sensor which detects whether or not the ball screw reaches to a back ward position which is positioned by a predetermined distance from the plunger, wherein the backward position detection sensor detects a position of an upper end of the ball screw for detecting a distance where the ball screw retreats with respect to the plunger, the discharge device confirms whether or not a lower end of the ball screw reaches a predetermined position at which the filling amount of the viscous material in the cylinder is maximum by detecting the position of the upper end of the ball screw, and the supply valve opens to supply the viscous material to the cylinder when the lower end of the ball screw reaches the predetermined position.

6. The discharge device according to claim 1, comprising:

a discharge valve which controls the discharge of the viscous material through the nozzle.

7. A liquid supply method for supplying a viscous material to a discharge device for discharging the viscous material, wherein the discharge device includes:

a supply valve which controls a supply of the viscous material to a cylinder;

a plunger which applies a pressure to the viscous material supplied to the cylinder;

a ball screw which is movable in a same direction as a back-and-forth direction of the plunger;

a motor which is connected to the ball screw through a power transmission mechanism; and a pressure sensor which is arranged in the cylinder and detects a pressure of the viscous material supplied into the cylinder, the plunger and the ball screw are not connected, and the method comprises:

supplying the viscous material by opening the supply valve in a state where the ball screw starts moving;

correcting an internal pressure by raising the ball screw, while the supply valve is closed, to drop the internal pressure of the cylinder to a desired value after the viscous material is supplied to the cylinder; and monitoring the internal pressure of the cylinder after correcting the internal pressure.

8. The liquid supply method according to claim 7, comprising:

detecting whether or not the viscous material is filled in the cylinder to a maximum extent by a photoelectric sensor included in the discharge device.

* * * * *